US008648586B2

(12) United States Patent
Singh et al.

(10) Patent No.: US 8,648,586 B2
(45) Date of Patent: Feb. 11, 2014

(54) CIRCUIT FOR SENSING LOAD CURRENT OF A VOLTAGE REGULATOR

(75) Inventors: Saumitra Singh, Bangalore (IN); Rupak Ghayal, Bangalore (IN); Venkata Ravindra Kumar Narkedamilli, Bhimavaram (IN)

(73) Assignee: Cadence AMS Design India Private Limited, Karnataka (IN)

( * ) Notice: Subject to any disclaimer, the term of this patent is extended or adjusted under 35 U.S.C. 154(b) by 309 days.

(21) Appl. No.: 13/082,420

(22) Filed: Apr. 8, 2011

(65) Prior Publication Data

US 2012/0176112 A1 Jul. 12, 2012

(30) Foreign Application Priority Data

Jan. 11, 2011 (IN) ..... 91/CHE/2011

(51) Int. Cl.
*G05F 3/20* (2006.01)

(52) U.S. Cl.
USPC ..... 323/316; 323/315

(58) Field of Classification Search
USPC ..... 323/311, 312, 313, 314, 315, 316, 317; 327/538, 539, 540, 541
See application file for complete search history.

(56) References Cited

U.S. PATENT DOCUMENTS

| | | | | |
|---|---|---|---|---|
| 4,885,477 | A * | 12/1989 | Bird et al. | 327/52 |
| 7,122,997 | B1 * | 10/2006 | Werking | 323/313 |
| 8,149,021 | B2 * | 4/2012 | Mikami et al. | 327/103 |
| 8,232,781 | B2 * | 7/2012 | Marino et al. | 323/271 |
| 2010/0148758 | A1 * | 6/2010 | Lo et al. | 324/140 R |
| 2011/0084678 | A1 * | 4/2011 | Tang et al. | 323/284 |

* cited by examiner

*Primary Examiner* — Nguyen Tran
*Assistant Examiner* — Afework Demisse
(74) *Attorney, Agent, or Firm* — Rosenberg, Klein & Lee

(57) ABSTRACT

A circuit for sensing load current of a voltage regulator. The circuit includes a power transistor and a mirror transistor. A first transistor sizing circuit is coupled to the power transistor and is operable to control size of the power transistor based on a bias voltage of the power transistor, thereby regulating a first voltage for varying load conditions. The circuit also includes a feedback amplifier coupled to the power transistor and the mirror transistor. A transistor is coupled to the feedback amplifier and the mirror transistor. An analog to digital converter (ADC) is coupled to the transistor. A second transistor sizing circuit is coupled to the mirror transistor, the transistor, and the ADC. The second transistor sizing circuit is responsive to an output voltage to control size of the mirror transistor, thereby ensuring that accuracy of output voltage sensed by ADC is not limited by ADC's resolution.

21 Claims, 3 Drawing Sheets

- PRIOR ART -

CIRCUIT FOR SENSING LOAD CURRENT OF A VOLTAGE REGULATOR

TECHNICAL FIELD

Embodiments of the current disclosure described herein provide a circuit for sensing load current of a voltage regulator.

BACKGROUND

Voltage regulators are used for providing regulated voltage supply to electronic circuits. An example of a voltage regulator 100 is shown in FIG. 1. The voltage regulator 100 includes a p-type metal-oxide-semiconductor (PMOS) transistor 105, a device 110, and a capacitor 115. A load current flows through the device 110. The capacitor 115 is connected in parallel to the device 110. Examples of the device 110 can include an ammeter, a resistor or any current sensing device. The PMOS transistor 105 has a drain connected to an output terminal ($V_{OUT}$), a gate, and a source connected to a voltage supply ($V_{DD}$). A gate signal is provided to the gate to regulate the voltage being supplied to the output terminal.

In one embodiment, to sense and measure the load current supplied by the voltage regulator 100, a series resistive element can be placed in series with the device 110, and the voltage drop across the resistive element can be measured using an analog to digital converter (ADC). The maximum value of the drop across the resistive element is VMAX=VIN−VDS_MIN−VOUT. VDS_MIN is the dropout tolerable across the PMOS transistor 105. Hence, the resistance of the resistive element is determined to be RMAX=VMAX/IMAX.

Given RMAX is determined as above, VMAX can be measured through the ADC. However, for a load current I significantly lower than the current IMAX, the input to the ADC would be scaled down by the ratio of I/IMAX. The voltage measurement would be limited by ADC's resolution. The finite resolution of the ADC limits the minimum detectable current through this arrangement with a good accuracy.

In another embodiment, the load current can be sensed using a current mirror circuit by dumping the mirrored current on a resistor, and sensing the voltage developed across the resistor with an ADC. However, sensing of the load current is limited by the resolution of the ADC.

It is desired to have a voltage regulator that can sense the load current and overcome the effects of the ADC resolution.

SUMMARY

Embodiments of the current disclosure described herein provide a circuit sensing load current of a voltage regulator.

A circuit for regulating voltage includes a power transistor having a source, a drain, and a gate, the power transistor responsive to a voltage at the gate and a voltage at the source to output a first voltage at the drain of the power transistor. A first transistor sizing circuit is coupled to the power transistor, the first transistor sizing circuit operable to control size of the power transistor based on a bias voltage of the power transistor. A mirror transistor having a source, a drain, and a gate, the gate of the mirror transistor is coupled to the gate of the power transistor, the mirror transistor responsive to a voltage at the gate and a voltage at the source to output a second voltage at the drain of the mirror transistor. A feedback amplifier coupled to the power transistor and the mirror transistor, the feedback amplifier responsive to the first voltage and the second voltage, to output a difference in magnitude of the first voltage and the second voltage, amplified by its gain. A transistor coupled to the feedback amplifier and the mirror transistor, the transistor responsive to the difference in magnitude of the first voltage and the second voltage to provide an output voltage, amplified by feedback amplifier's gain. An analog to digital converter (ADC) coupled to the transistor to convert the output voltage to a digital signal. A second transistor sizing circuit is coupled to the mirror transistor, the transistor, and the ADC, the second transistor sizing circuit responsive to the output voltage and operable to control size of the mirror transistor based on the output voltage, thereby controlling variation in the output voltage due to loading effect of the ADC.

An example of a method for sensing load current at varying load conditions includes sensing a bias voltage at a power transistor. The method also includes altering size of the power transistor if the bias voltage is lower than a predefined bias voltage and the size of the power transistor is above a first size threshold. Further, the method includes sensing a voltage level at output of a mirror transistor. Further, the method includes altering size of the mirror transistor if the voltage level is lower than a voltage threshold and the size of the mirror transistor is below a second size threshold, thereby regulating voltage at varying load conditions.

Other aspects and example embodiments are provided in the figures and the detailed description that follows.

DETAILED DESCRIPTION OF THE EMBODIMENTS

In existing voltage regulators, sensing of load current across wide range of load current values has limited accuracy due to following factors. 1. Sensing current through a resistive sense, followed by an ADC, would require a large dynamic range, dictated by the dynamic range of sensed currents. 2. A current mirror based sensing circuit would also be limited by resolution of the ADC. 3. A resistive ranging circuit would affect drop-out voltage range of the voltage regulator. 4. A current mirror circuit suffers from significantly higher mismatch errors at low currents, when the output power transistor goes into a linear region. The current disclosure addresses the above mentioned problems using a circuit described in FIG. 2.

Figure 1:
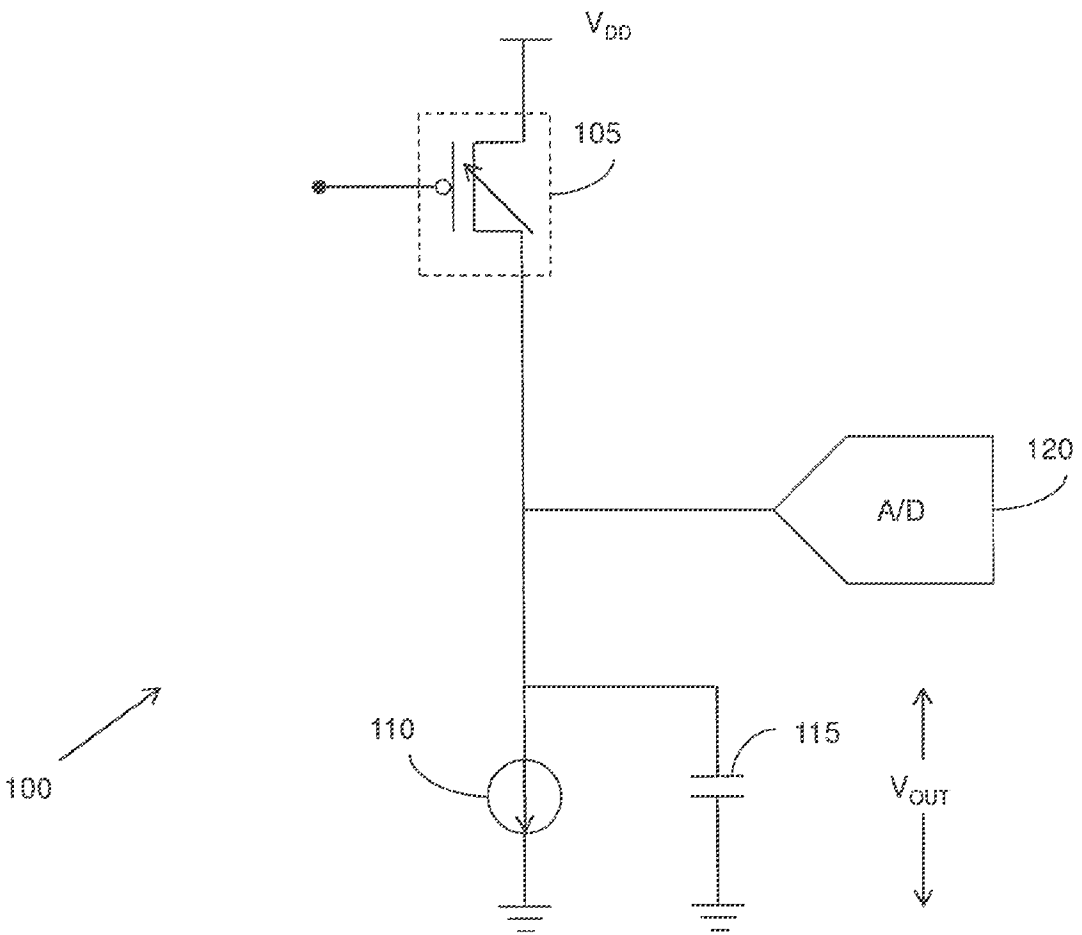
FIG. 1 is a schematic diagram of a voltage regulator, in accordance with a prior art.
Figure 2:
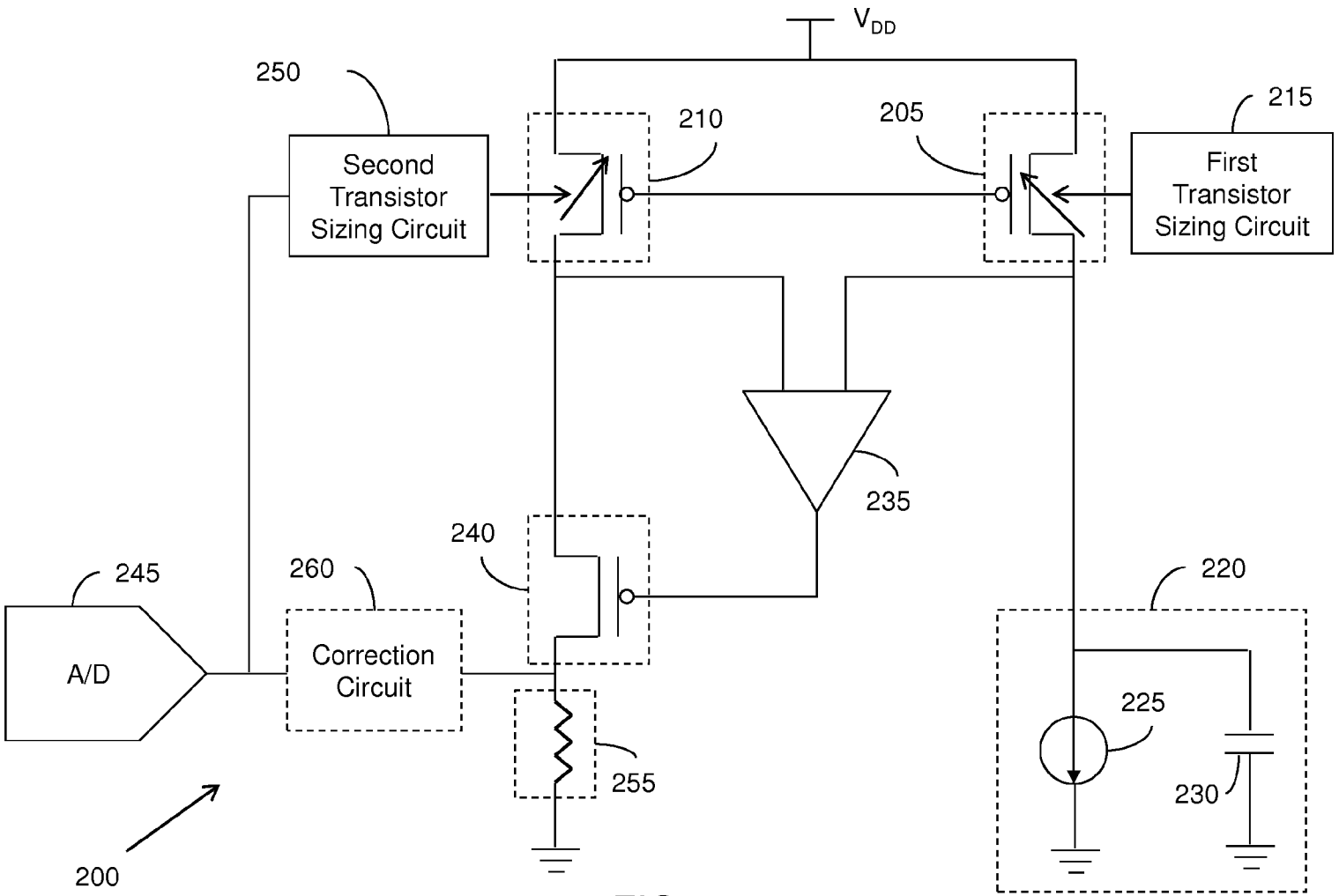
FIG. 2 is a schematic diagram of a circuit for regulating voltage at varying load conditions, in accordance with one embodiment.

FIG. 2 is a schematic diagram of a circuit 200 for regulating voltage at varying load conditions.

The circuit 200 includes a power transistor 205, herein referred to as a transistor 205 and a mirror transistor 210, herein referred to as a transistor 210. The transistor 205 and the transistor 210 can include one or more metal oxide semiconductor (MOS) transistors.

The transistor 205 has three terminals, a source, a drain, and a gate. The transistor 205 is responsive to a voltage at the gate and a voltage supply at the source to output a first voltage at the drain of the transistor 205.

The transistor 210 has three terminals, a source, a drain, and a gate. The gate of the transistor 210 is coupled to the gate of the transistor 205. The transistor 210 is responsive to a voltage at the gate and a voltage at the source to output a second voltage at the drain of the transistor 210.

The circuit 200 also includes a first transistor sizing circuit 215 coupled to the transistor 205. The first transistor sizing circuit 215 is operable to control size of the transistor 205 based on a bias voltage of the transistor 205. The bias voltage is defined as the difference between the gate to source voltage ($V_{gst}$) and an internal threshold (Vt) of the transistor 205. The bias voltage is used to determine the minimum gate to source voltage difference required to turn-on the transistor 205. The size of the transistor 205 is controlled by switching-off or switching-on MOS transistors among the one or more MOS transistors in the transistor 205. In one embodiment, the first transistor sizing circuit 215 includes a sensing unit for sensing the bias voltage and a control logic to determine the size of the transistor 205 based on the bias voltage.

The circuit 200 includes an output circuit 220 through which a load current is applied. In an embodiment, the output circuit 220 includes a current load 225. The output circuit 220 also includes a filter capacitor 230.

The circuit 200 also includes a feedback amplifier 235. One input of the feedback amplifier 235 is coupled to the transistor 205 and a second input of the feedback amplifier 235 is coupled to the transistor 210. The feedback amplifier 235 is responsive to the first voltage and the second voltage, to output a difference in magnitude of the first voltage and the second voltage, amplified by its high amplifier gain A. The feedback amplifier 235 enables achieving the second voltage similar to the first voltage. The feedback amplifier 235 is a high gain amplifier.

Further, the circuit includes a transistor 240 coupled to the feedback amplifier 235 and the transistor 210. The transistor 240 is a MOS transistor. The transistor includes three terminals, a gate connected to the output of the feedback amplifier 235, a source coupled to the drain of the transistor 210 and a drain. The transistor 240 isolates current generated from the feedback amplifier 235 from a load current at the drain of the mirror transistor 210, and passes the load current at the source terminal to the drain terminal of the transistor 240. In an embodiment, the transistor 240 is responsive to the difference in magnitude of the first voltage and the second voltage to provide an output voltage, called error voltage. The transistor 240 is a metal oxide semiconductor transistor.

The circuit 200 includes an analog to digital converter (ADC) 245 coupled to the drain of the transistor 240 to convert the output voltage, VSENSE to a digital signal. The output voltage is obtained due to the voltage created across resistor 255 due to current in mirror transistor 210. VSENSE=I_mirror*R, where R is the resistance of resistor 255, and I_mirror is the drain current of 210.

The circuit 200 also includes a second transistor sizing circuit 250 that is coupled to the transistor 210, the drain of the transistor 240, and the ADC 245. The second transistor sizing circuit 250 is responsive to the output voltage and operable to control size of the transistor 210 based on the output voltage VSENSE. The size of the transistor 210 is controlled by switching-off or switching-on MOS transistors among the one or more MOS transistors in the transistor 210. In one embodiment, the second transistor sizing circuit 250 includes a sensing unit for sensing the sensed output voltage VSENSE and a control logic to determine the size of the transistor 210 based on the output voltage VSENSE.

The circuit 200 also includes the resistive element 255 that functions as a current to voltage converter. It generates a voltage VSENSE, which is proportional to the current carried in the mirror transistor 210, through Ohm's law (V=IR). One end of the resistive element 255 is coupled to the drain of the transistor 240 and other end is coupled to a ground. In one example, the resistive element 255 can be a resistor.

In some embodiments, the transistor 205 is a low dropout voltage regulator transistor.

In some embodiments, the control logic of the first transistor sizing circuit 215 is operable to determine the size of the transistor 205 based on at least one of the load current and a region of operation of the transistor 205. The control logic of the second transistor sizing circuit 250 is also operable to determine the size of the transistor 210 based on at least one of the load current and the region of operation of the transistor 210. The load current and region of operation can be determined using existing techniques. For example, a mirror circuit.

In some embodiments, the circuit 200 can include a correction circuit 260 coupled between the second transistor sizing circuit 250 and the transistor 240. The correction circuit 260 is operable to calibrate gain variation and offset errors. The bias voltage corresponds to the minimum gate to source voltage difference required to turn the MOS transistor ON.

In an embodiment, the circuit 200 senses a first load condition to determine the load current to be supplied by the transistor 205. The transistor 205 operates with a first bias voltage ($V_{gst1}$)=Vgs1−Vt. The first bias voltage Vgst1 is defined as the difference between the gate to source voltage (Vgs1) and the internal threshold (Vt) of the transistor 205 for the first load condition. The bias voltage is used to determine the minimum gate to source voltage difference required to turn-on the transistor 205. The bias voltage at which the transistor 205 operates, changes for a second load condition. The circuit 200 determines the load current to be supplied by the transistor 205. The bias voltage reduces if the load at the output is reduced. For the second load condition, the transistor 205 operates at a second bias voltage ($V_{gst2}$)=Vgs2−Vt. The second bias voltage Vgst2 is defined as the difference between the gate to source voltage (Vgs2) and the internal threshold of the transistor 205 for the second load condition.

The first transistor sizing circuit 215 senses the second bias voltage of the first transistor 205 using the sensing unit. The control logic within the first transistor sizing circuit 215 compares the second bias voltage against a predefined bias voltage, herein also referred as reference bias voltage (Vgst_ref). If the second bias voltage is lesser in magnitude than the reference bias voltage, one or more MOS transistors of the transistor 210 are switched-off by the first transistor sizing circuit 215, thus increasing the bias voltage to greater than the minimum reference bias voltage (Vgst_ref).

In another embodiment, the transistor 205 is responsive to the voltage at the gate and the voltage supply $V_{DD}$ at the source, to output the first voltage at the drain of the transistor 205. The transistor 210 is responsive to the voltage at the gate and the voltage supply $V_{DD}$ at the source to output the second voltage at the drain of the transistor 210.

The transistor 210 mirrors the transistor 205 in generating the load current. The first voltage and the second voltage is input to the feedback amplifier 235. The feedback amplifier 235 in conjunction with the transistor 240 functions as a negative feedback amplifier resulting in the drain of the transistor 210 tracking the drain of the transistor 205. The load current at the drain of the transistor 210 tracks the load current at the drain of the transistor 205.

An output voltage is generated at the drain of the transistor 240 that corresponds to the current at the resistive element 255, a resistance value of the resistive element 255, and a ratio of the size of the transistor 210 to the size of the transistor 205.

The ADC 245 is coupled to the drain of the transistor 240. The output voltage is sensed by the ADC 245 for converting the output voltage to the digital signal. The digital signal can be used for reading the load current of the circuit 200.

For example, if $I_{load}$ is the load current generated by the transistor 210, $R_{sense}$ is the resistance of the resistive element, PT is the size of the transistor 205 and MT is the size of the transistor 210, then the output voltage sensed by the ADC 245 is determined as:

$$V_{sense}=[I_{load}*R_{sense}*(MT/PT)] \quad (1)$$

For the second load condition, the second transistor sizing circuit 250 senses the output voltage using the sensing unit. The control logic within the second transistor sizing circuit 250 compares the output voltage against a reference voltage (for example, a fraction of ADC's reference voltage). If the output voltage is lesser in magnitude than the reference voltage, one or more MOS transistors of the transistor 210 are switched-on by the second transistor sizing circuit 250, thus increasing the magnitude of the output voltage sensed by the ADC 245. The output voltage thus generated at the drain of the transistor 240 is sensed by the ADC 245.

For example, for an ADC with reference voltage 3.0V, we will set threshold to 1.5V. Thus, the ADC's input will be 1.5V or higher. Consider an ADC is 10 bit (1024 steps). Then, the ADC's resolution is 3.0V/1024~=3 mV. If the ADC converts a 1.5V input, it will make a resolution error of 3 mV/1.5V=0.2%. If on the other hand, the ADC converts a low input voltage, e.g. 100 mV, it would make an error of 3.0 mV/100 mV=3.0%. Thus, we reduce the magnitude of error due to limited ADC resolution by increasing the input to ADC.

In some embodiments, the correction circuit 260 is operable to calibrate gain variation and offset errors for a known process mismatch.

Figure 3:
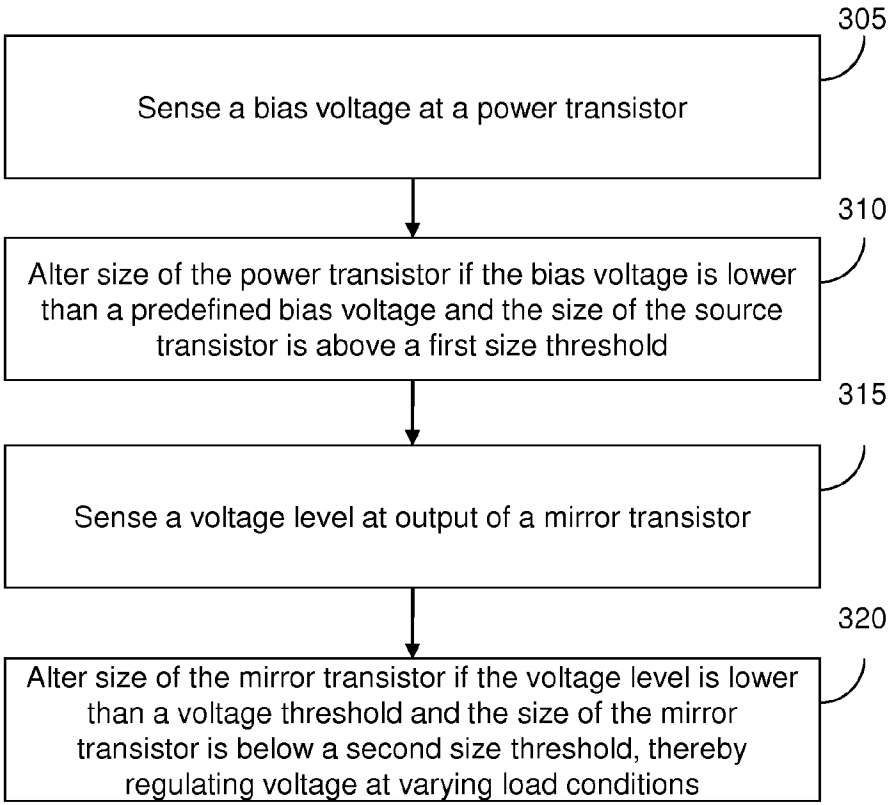
FIG. 3 is a flowchart illustrating a method for sensing load current, in accordance with one embodiment.

FIG. 3 is a flowchart illustrating a method for sensing load current, in accordance with one embodiment.

A power transistor is responsive to a voltage supply at a source and a gate signal to generate a first voltage at a drain of the power transistor. The power transistor includes one or more MOS transistor units of binary weighted sizes. The smallest unit in the binary weighted transistor units is of size 'P0'. Then Pth unit's size is given by $2^{(p-1)}$*P0. If there are N binary weighted units, the total size of the power transistor thus corresponds to $(2^N-1)$*P0. The first voltage corresponds to supply of a load current.

The load current is mirrored using a mirror transistor. The mirror transistor is responsive to the voltage supply at a source and the gate signal to generate a second voltage at a drain of the mirror transistor. The mirror transistor includes one or more MOS transistor units of binary weighted sizes. The smallest unit in the binary weighted transistor units is of size 'M0'. Then Pth unit's size is given by $2^{(P-1)}$*M0. If there are M binary weighted units, the total size of the mirror transistor thus corresponds to $(2^M-1)$*M0. A feedback amplifier, inputs of the feedback amplifier are fed with the first voltage and second voltage, and the output of the feedback amplifier is coupled in feedback to the drain of the mirror transistor. Thus the second voltage responds to the first voltage mirroring and the load current, as the gate and source voltages of both power and mirror transistor are same and the drain voltages are forced to be the same by the feedback loop.

In some embodiments, current may be generated by the feedback amplifier that results in mismatch of the load current generated by the mirror transistor and the power transistor. A MOS transistor 240, is coupled to the output of the feedback amplifier that ensures the current generated from the feedback amplifier is isolated from the load current at the drain of the mirror transistor 210, and passes the current at the drain of the mirror transistor to the drain terminal of the MOS transistor 240. The voltage at the drain terminal of the MOS transistor is sensed by an ADC.

In an embodiment, due to reduced load condition at the drain of the power transistor, the magnitude of the load current is reduced.

At step 305, a bias voltage (Vgst) is sensed at the power transistor. The bias voltage corresponds to a difference between a gate to source voltage (Vgs) of the power transistor and minimum voltage (Vt) required to turn on the power transistor. The bias voltage is used to determine the minimum gate to source voltage difference required to turn-on a transistor. In an embodiment, the bias voltage of the power transistor is reduced due to reduced load.

At step 310, a size of the power transistor is altered. Here, the size of the power transistor is reduced if the bias voltage is lower than a predefined bias voltage and the size of the power transistor is above a first size threshold. The predefined bias voltage is herein also referred as a reference bias voltage 'Vgs_ref'. The reference bias voltage Vgs_ref may correspond to a minimum voltage for operation of the power transistor in saturation mode operation. The first size threshold is a minimum size of the power transistor or the power transistor of size 'PT'.

For example, if the power transistor is implemented as binary weighted arrangement of N units, where all N units are turned on at beginning and unit 1 is minimum sized unit and unit N is largest sized unit. Then, at step 310, if the bias voltage (Vgst) is lower than reference bias voltage (Vgs_ref), the highest sized unit which is still turned on is turned off. So the number of units that are ON reduces from N to (N−1) and so on till the conditions of 310 are satisfied, or the total number of units turned on has reached its minimum.

If one of, the reference bias voltage (Vgs_ref) is greater than the bias voltage or the size of the power transistor is equal to a first size threshold, then step 315 is performed. Else, step 310 is performed.

It is understood that reducing the size of the power transistor leads to lower current mirroring mismatch errors, as power transistor operates closer to saturation region.

At step 315, a voltage level is sensed at output (drain) of the mirror transistor.

At step 315, a size of the mirror transistor is altered. Here, the size of the mirror transistor is increased if the voltage level at the drain of MOS transistor 240 is lower than a voltage threshold and the size of the mirror transistor is below a second size threshold.

The second size threshold is a maximum size of the mirror transistor or the mirror transistor of size 'MT'.

For example, if the mirror transistor may be implemented as binary weighted arrangement of M units, where only one out of M units is turned on at beginning and unit 1 is minimum sized unit and unit M is largest sized unit. Then, at step 315, if the voltage level at drain of transistor 240 is lower than the voltage threshold, the lowest sized unit which is still turned off is turned on. So the number of units that are ON increases from 1 to 2 and so on till the conditions of step 315 are satisfied, or the total number of units turned on has reached its maximum of M. In one embodiment, the voltage threshold is predefined for the mirror transistor.

If one of, voltage level is greater than the voltage threshold or the size of the mirror transistor is equal to a second size threshold, then the voltage level at the output (drain terminal) of the MOS transistor is read to determine the load current. The voltage level corresponds to a current at the resistive element, a resistance value of the resistive element, and a ratio of the size of the mirror transistor and the size of the power transistor.

The voltage level that is generated by the mirror transistor at the end of step 315 is read by the ADC.

After reading by the ADC, the actual load current reading is determined using:

$$I=(VSENSE/RSENSE)*(PT_FINAL/MT_FINAL) \quad (2)$$

Wherein, PT_FINAL is the size of the power transistor after step 310 and MT_FINAL is the size of the mirror transistor after step 320.

If the power transistor and mirror transistor are implemented as binary weighted units, and N_FINAL is the number of Power transistor units which are on after step 310, and M_FINAL is the number of mirror transistor units on after step 320, then, after reading by the ADC, the actual voltage reading is determined by:

$$I=(VSENSE/RSENSE)*(2^{(N_FINAL-M_FINAL)}). \quad (3)$$

The computation of 'I' in equation (3) is performed by adding (N_FINAL−M_FINAL) zeros as LSBs to the binary digit. Thus, the system described increases the effective resolution of the sensed current without increasing the complexity of digital calculation.

In an embodiment, the voltage level VSENSE is digitized using an ADC. As can be observed above, the ADC is required only for digitizing VSENSE. The rest of the information required by the digital processor is N_FINAL and M_FINAL that can be digitally read by a digital processor. The value of sense resistance RSENSE is a pre-determined constant. Thus, through using the above technique, the effective resolution of the sensed signal is increased by (M+N) bits, wherein N is the number of binary weighted power transistor units, and N is the size of binary weighted mirror transistor units.

In the foregoing discussion, the term "coupled" refers to either a direct electrical connection between the devices connected or an indirect connection through one or more passive or active intermediary devices. The term "circuit" means at least either a single component or a multiplicity of components, either active or passive, that are connected together to provide a desired function. The term "signal" means at least one current, voltage, charge, data, or other signal.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The forgoing description sets forth numerous specific details to convey a thorough understanding of the invention. However, it will be apparent to one skilled in the art that the invention may be practiced without these specific details. Well-known features are sometimes not described in detail in order to avoid obscuring the invention. Other variations and embodiments are possible in light of above teachings, and it is thus intended that the scope of invention not be limited by this Detailed Description, but only by the following Claims.

What is claimed is:

1. A circuit comprising:

a power transistor portion defining a source, a drain, and a gate, the power transistor portion responsive to a voltage at the gate and a voltage at the source to output a first voltage at the drain of the power transistor portion, the power transistor portion including a plurality of transistors;

a first transistor sizing circuit coupled to the power transistor portion, the first transistor sizing circuit operable to selectively reconfigure the power transistor portion in the transistors enabled therein based on a bias voltage of the power transistor portion, thereby controlling the size of the power transistor portion and regulating the first voltage for varying load conditions;

a mirror transistor portion defining a source, a drain, and a gate, the gate of the mirror transistor portion coupled to the gate of the power transistor portion, the mirror transistor portion responsive to a voltage at the gate and a voltage at the source to output a second voltage at the drain of the mirror transistor portion, the mirror transistor portion including a plurality of transistors;

a feedback amplifier coupled to the power transistor portion and the mirror transistor portion, the feedback amplifier responsive to the first voltage and the second voltage, to output a difference in magnitude of the first voltage and the second voltage;

an output transistor coupled to the feedback amplifier and the mirror transistor portion, the output transistor responsive to the difference in magnitude of the first voltage and the second voltage to provide an output voltage;

an analog to digital converter (ADC) coupled to the output transistor to convert the output voltage to a digital signal; and a second transistor sizing circuit coupled to the mirror transistor portion, the output transistor, and the ADC, the second transistor sizing circuit responsive to the output voltage and operable to selectively reconfigure the mirror transistor portion in the transistors enabled therein based on the output voltage, thereby controlling the size of the mirror transistor portion and varying the output voltage due to loading effect of the ADC.

2. The circuit as claimed in claim 1, wherein the power transistor portion is a power stage transistor of a low dropout voltage regulator.

3. The circuit as claimed in claim 1, further comprising:

a correction circuit coupled between the second transistor sizing circuit and the output transistor, the correction circuit operable to calibrate gain variation and offset errors.

4. The circuit as claimed in claim 1, wherein the output transistor is a metal oxide semiconductor transistor.

5. The circuit as claimed in claim 1, wherein the output transistor is a bipolar junction transistor.

6. The circuit as claimed in claim 1, wherein the feedback amplifier in conjunction with the output transistor functions as a negative feedback amplifier.

7. The circuit as claimed in claim 1, further comprising: a resistive element that functions as a load.

8. The circuit as claimed in claim 7, wherein the output voltage is proportional to a current at the resistive element, a resistance value of the resistive element, and a ratio of the size of the mirror transistor portion to the size of the power transistor portion.

9. The circuit as claimed in claim 1, further comprising:

a current sensing device to sense a load current at the drain of the power transistor portion.

10. The circuit as claimed in claim 1, wherein the first transistor sizing circuit comprises:

a sensing unit for sensing the bias voltage; and a control logic to determine the size of the power transistor portion based on the bias voltage.

11. The circuit as claimed in claim 10, wherein the control logic is further operable to determine the size of the power transistor portion based on at least one of:

the load current of the power transistor portion; and region of operation of the power transistor portion.

12. The circuit as claimed in claim 1, wherein the second transistor sizing circuit comprises:

a sensing unit for sensing the output voltage; and a control logic to determine the size of the mirror transistor portion based on the output voltage.

13. The circuit as claimed in claim 12, wherein the control logic is further operable to determine the size of the mirror transistor portion based on at least one of:

the load current of the mirror transistor portion; and region of operation of the mirror transistor portion.

14. A method comprising:

sensing a bias voltage at a power transistor portion including a plurality of transistors;

altering size of the power transistor portion by selectively reconfiguring in the transistors enabled therein if the bias voltage is lower than a predefined bias voltage and the size of the power transistor portion is above a first size threshold;

sensing a voltage level at output of a mirror transistor portion comprising a plurality of transistors; and altering size of the mirror transistor portion by selectively reconfiguring in the transistors enabled therein if the voltage level is lower than a voltage threshold and the size of the mirror transistor portion is below a second size threshold, thereby regulating voltage at varying load conditions.

15. The method as claimed in claim 14, wherein altering size of the mirror transistor portion reduces resolution error of an analog to digital converter.

16. The method as claimed in claim 14, wherein altering size of the power transistor portion comprises decreasing size of the power transistor portion by switching off one or more of the plurality of transistors within the power transistor portion.

17. The method as claimed in claim 16, wherein decreasing size of the power transistor portion comprises decreasing the size of the power transistor portion by a multiple of 2.

18. The method as claimed in claim 14, wherein altering size of the mirror transistor portion comprises increasing size of the mirror transistor portion by switching off one or more of the plurality of transistors within the mirror transistor portion.

19. The method as claimed in claim 18, wherein increasing size of the mirror transistor portion comprises increasing the size of the mirror transistor portion by a multiple of 2.

20. The method as claimed in claim 14 further comprising:

reading of a voltage level by the analog to digital converter; and determining a load current based on the voltage level read by the analog to digital converter, the power transistor portion size and the mirror transistor portion size.

21. The method as claimed in claim 14 further comprising: calibrating gain variation and offset errors.

* * * * *